United States Patent [19]

Piscitelli et al.

[11] Patent Number: 4,621,887

[45] Date of Patent: Nov. 11, 1986

[54] ELECTRICAL CONTACT

[75] Inventors: R. Amelia Piscitelli, Sidney; David O. Gallusser, Oneonta; David L. Frear, Bainbridge; Valentine J. Hemmer, Sidney; Charles P. Fischer, Bainbridge, all of N.Y.

[73] Assignee: Allied Corporation, Morristown, N.J.

[21] Appl. No.: 241,802

[22] Filed: Mar. 9, 1981

[51] Int. Cl.[4] ..... H01R 4/10

[52] U.S. Cl. ..... 339/276 T

[58] Field of Search ..... 339/276 A, 276 R, 276 C, 339/276 D, 276 E, 276 F, 276 RB, 276 S, 276 SF, 276 T; 174/84 C

[56] References Cited

U.S. PATENT DOCUMENTS

| | | | |
|---|---|---|---|
| 1,654,340 | 12/1927 | McIntosh | 339/276 D UX |
| 1,833,145 | 11/1931 | Wilhelm | 339/276 R |
| 3,317,887 | 5/1967 | Henschen et al. | 339/276 T X |
| 3,538,239 | 11/1970 | Renshaw, Jr. | 339/276 R X |
| 3,761,872 | 9/1973 | Ebinger | 339/276 T |
| 3,976,385 | 8/1976 | Klopfer | 339/276 R X |
| 4,072,394 | 2/1978 | Waldron et al. | 339/276 T |
| 4,120,556 | 10/1978 | Waldron et al. | 339/276 T X |
| 4,184,736 | 1/1980 | Spaulding | 339/276 T X |

*Primary Examiner*—Mark Rosenbaum

*Attorney, Agent, or Firm*—R. J. Eifler; C. D. Lacina

[57] ABSTRACT

This invention is an electrical contct that includes an inner sleeve (10) that is stamped and formed from a single sheet of metal and is characterized by a plurality of apertures (11) in the sleeve (10) that have an axis of symmetry (11*a*) or a straight side (13) that is at an acute angle with the central axis (10*a*) of the sleeve.

9 Claims, 6 Drawing Figures

ELECTRICAL CONTACT

This invention relates to electrical connectors and more particularly to a stamped and formed electrical contact assembly mounted within the connector.

Electrical connectors generally have a shell or housing, a plurality of contacts, each of which are connected to separate incoming wires, and a dielectric insert assembly for fixedly or removably mounting the electrical contacts within the connector shell. Generally, each of the contacts within a connector is removable so that it may be connected either by soldering or crimping to an incoming wire. When an incoming wire is attached to a contact by crimping it is inserted into an axial passage in one end of the contact and then crimped to the contact to obtain an electrical and mechanical connection. The crimping operation is performed by a well known plier type tool that, when squeezed, applies pressure simultaneously, via indentors, to two pairs of diametrically opposed points in the wall of the contact passage. This deforms the wall into the wire in the passage. After the crimping operation is completed, each contact is inserted into the connector where they are retained by a contact retention mechanism.

Contacts for the connector may be either one piece contacts machined from metal stock or three piece contact assemblies. Examples of an electrical contact assembly may be found in U.S. Pat. No. 4,120,556 entitled "Electrical Contact Assembly" issued Oct. 17, 1978 and U.S. Pat. No. 4,072,394 entitled "Electrical Contact Assembly" issued Feb. 7, 1978. The contact assemblies are generally comprised of three pieces: an inner sleeve stamped and formed from a single sheet of metal, an intermediate sleeve; and an outer stainless steel sleeve. The inner sleeve generally includes a plurality of slots in the rear wire receiving portion to insure symmetrical deformation of the contact when it is crimped to a wire. However, although the slots provide symmetrical deformation they sometimes also cause the outer stainless steel sleeve to crack. This occurs because the slots may be aligned with the crimp tool indenters which would allow the indentors to push the stainless steel downward far enough to cause cracks in the outer sleeve. The cracks are undesirable because they weaken the wall of the outer sleeve, which may also weaken the connection between the wire and the contact. Accordingly, cracking of the stainless steel outer sleeve of a three piece contact assembly has been a problem.

DISCLOSURE OF THE INVENTION

This invention provides an inner sleeve for a three piece contact assembly that is configured to prevent cracking of an outer stainless steel sleeve when the contact is crimped to a wire. The invention is characterized by a stamped and formed three piece contact inner sleeve that includes a plurality of apertures, in the rear wire receiving portion of the sleeve, that have an axis of symmetry or a straight side that is at an acute angle with the central axis of the sleeve.

Accordingly, one advantage of the invention is that it provides a stamped and formed three piece contact that does not exhibit cracking of the outer stainless steel sleeve when crimped to an incoming wire.

DETAILED DESCRIPTION OF THE INVENTION

Figure 1:
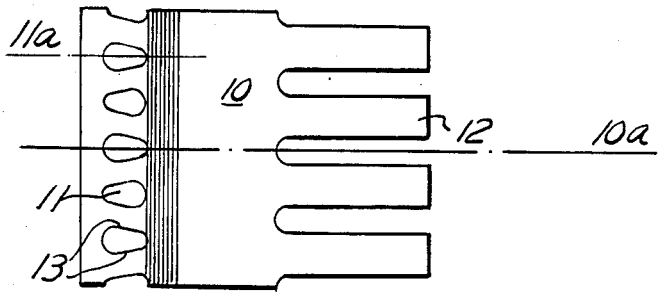
FIGS. 1 through 4 illustrate different embodiments of an inner sleeve for a three piece contact incorporating the principles of the invention.

Referring now to the drawings, FIG. 1 is a blank of metal, such as beryllium copper, that has been stamped into a configuration that may be formed into a sleeve. The blank includes, at the forward mating end, fingers 12 that will be radially and resiliently deflectable when the sleeve is formed. The rear portion of the blank 10 includes a plurality of apertures 11. In the preferred embodiment the apertures 11 are tear shaped and include an axis of symmetry 11*a* and straight side portions 13 that are at an angle with the central axis 10*a* of the blank 10. Accordingly, when the blank 10 is formed into a sleeve, the straight side portions 13 of the apertures 11 will also be at an angle with the central axis 10*a* of the sleeve.

Figure 2:
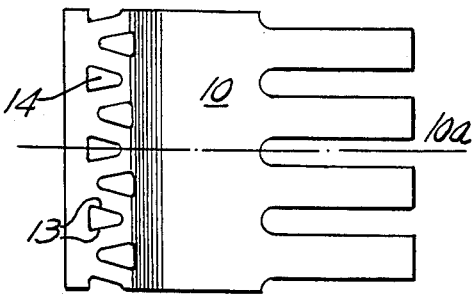

FIG. 2 is another embodiment of the invention wherein the configuration of each aperture 14 is generally triangular. Each triangularly shaped aperture 14 includes straight side portions 13 that are at an angle with the central axis 10*a* of the blank 10. It is important that the sides 13 of an aperture 14 not be parallel to the central axis 10*a* so that the sides 13 will not be parallel to the indentors of a crimping tool when a wire is crimped to the blank when it has been formed into a sleeve.

Figure 3:
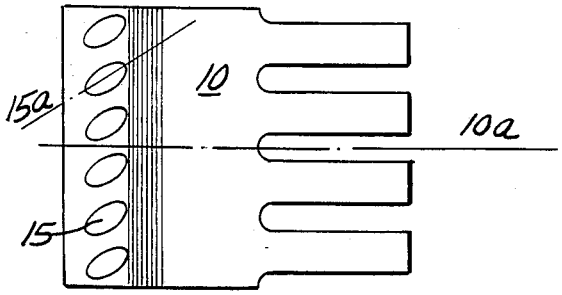

FIG. 3 illustrates another embodiment of the invention wherein each aperture 15 is eliptically shaped and has a central axis of symmetry 15*a* that is at an angle with the central axis 10*a* of the blank 10. In this embodiment, the apertures 15 do not have any straight sides but are curvilinear but each curvilinear side always present an angle to the central axis 10*a* of the blank and, accordingly, will not be parallel to the indentors of a crimping tool when a wire is crimped to the blank 10 after it has been formed into a sleeve.

Figure 4:
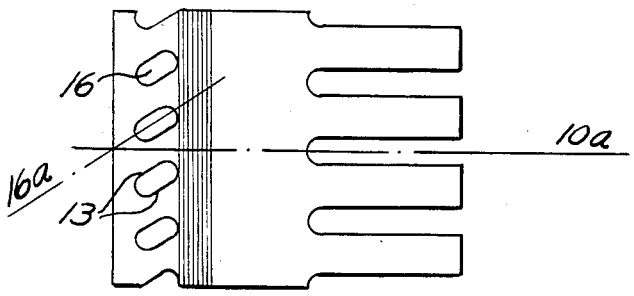

FIG. 4 is another embodiment of the invention wherein the configuration of each aperture is a slot 16. Each slot having a central axis or axis of symmetry 16*a* that is at an acute angle with the central axis 10*a* of the blank 10. Each of the apertures 16 has an elongated configuration which includes straight side portions 13 that are also at an angle with the central axis 10*a* of the blank 10.

Figure 5:
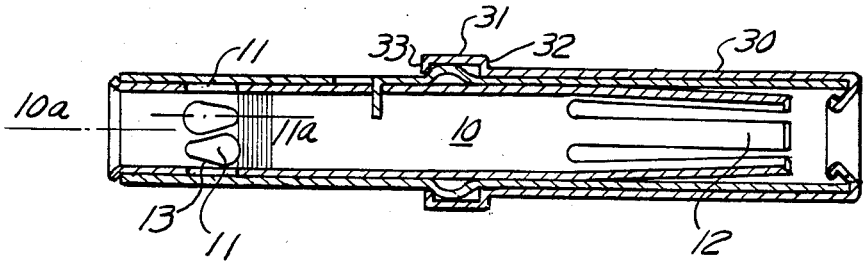
FIGS. 5 and 6 illustrate a three piece electrical contact assembly incorporating the principles of the invention.

FIG. 5 illustrates a three piece contact assembly that includes an inner sleeve 10, an intermediate sleeve and an outer forward sleeve 30. For purposes of illustration, the inner sleeve 10 includes the configuration of the apertures 11 shown in FIG. 2, which is the preferred embodiment. This cross-sectional view illustrates a completely formed inner sleeve 10 with the radially deflectable fingers 12 at the mating end and the aperture 11 at the wire receiving. The intermediate sleeve is comprised of stainless steel and will receive the crimp indentors (not shown) when a wire (not shown) is inserted into the rear wire receiving portion of the inner sleeve 10 and the intermediate sleeve is crimped inwardly to a wire. Since the aperture 11 have sides 13 that are not parallel to the crimp tool indentors fracture or cracking of the stainless steel intermediate sleeve is prevented. The forward sleeve 30 which is comprised also of stainless steel includes an enlarged portion 31 which includes forwardly 32 and rearwardly 33 facing shoulders that are adapted to cooperate with a contact retaining mechanism (not shown) within a connector assembly.

Figure 6:
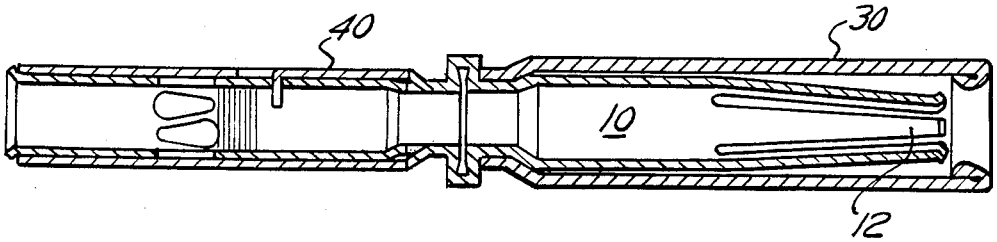

FIG. 6 illustrates another type of three piece contact wherein there is a inner sleeve 10, a forward sleeve 30 and a rear sleeve 40. In this embodiment, the enlarged portion and forwardly facing and rearwardly facing shoulders to retain the contact within the connector assembly is formed on the inner sleeve 10. The rear sleeve 40, which is comprised of stainless steel, and the configuration of the inner sleeve 10 prevents cracking or fracture of the rear stainless steel sleeve 40 when a wire (not shown) is crimped to the contact assembly by applying pressure to the indentors of a crimp tool in contact with the rear stainless steel sleeve 40.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein be used to illustrate the principles of the invention and not to limit the scope thereof.

Having described the invention, what is claimed is:

1. A one piece unitary electrical contact stamped and formed from a single sheet of metal, said contact comprising:

a sleeve having a central axis, a front mating portion and a rear wire receiving portion having at least four slots in the wall thereof, each slot having a generally triangular configuration including straight side portions that are at an acute angle with the central axis of said sleeve.

2. The contact as recited in claim 1 wherein said slots are symmetrically arranged around the central axis of said sleeve.

3. The contact as recited in claim 1 wherein the front mating portion of said sleeve includes four resiliently and radially deflectable fingers.

4. In combination with an electrical socket type contact assembly of the type having: an inner sleeve stamped and formed from a single sheet of metal, said sleeve having a central axis, a front mating portion, a rear wire receiving portion having a plurality of apertures, and a plurality of axially extending fingers in the front mating portion of the sleeve, said fingers resiliently deflectable in a radial direction; an intermediate sleeve telescopically mounted over said inner sleeve; and an outer sleeve telescopically mounted on the front portion of said intermediate sleeve, said outer sleeve having an enlarged portion that includes a forwardly facing shoulder, the improvement wherein:

the apertures have straight side portions that are at an acute angle with the central axis of said inner sleeve.

5. A one piece unitary electrical contact stamped and formed from a single sheet of metal, said contact comprising:

a sleeve having a central axis, a forward mating portion and a rear wire receiving portion having at least four apertures in the wall thereof each of said apertures having a configuration that is generally eliptical.

6. The contact as recited in claim 5 wherein the longitudinal axis of said elipse is at an acute angle with the central axis of said sleeve.

7. The contact as recited in claims 5 or 6 wherein the front mating portion of said sleeve includes at least four resiliently and radially deflectable fingers.

8. A one piece unitary electrical contact stamped and formed from a single sheet of metal, said contact comprising:

a sleeve having a central axis, a front mating portion and a rear wire receiving portion having at least four apertures in the wall thereof each of said apertures having a configuration which is generally in the shape of a tear drop.

9. The contact as recited in claim 8 wherein the front mating portion of said contact includes four resiliently and radially deflectable fingers.

* * * * *